US006398071B1

(12) United States Patent
Fellers

(10) Patent No.: US 6,398,071 B1
(45) Date of Patent: Jun. 4, 2002

(54) APPARATUS FOR SEED CONTAINER AND SHELL RECEPTACLE

(76) Inventor: Lisa Ann Fellers, 6212 Hulen Bend Cir., No. 514, Fort Worth, TX (US) 76132

( * ) Notice: Subject to any disclaimer, the term of this patent is extended or adjusted under 35 U.S.C. 154(b) by 0 days.

(21) Appl. No.: 09/432,374

(22) Filed: Nov. 1, 1999

(51) Int. Cl.[7] ..... B23Q 7/00; G07F 11/00; A47F 1/00

(52) U.S. Cl. ..... 221/174; 221/97; 221/256

(58) Field of Search ..... 221/90, 97, 154, 221/99, 100, 174, 255, 256, 309; 206/541, 547, 546

(56) References Cited

U.S. PATENT DOCUMENTS 2,352,066 A * 6/1944 Apfelbaum ..... 221/90 X
4,142,649 A * 3/1979 Forgey ..... 221/97 X
4,444,324 A * 4/1984 Grenell ..... 206/545 X
5,535,889 A * 7/1996 Lin ..... 206/546 X
5,921,394 A * 7/1999 Shroff ..... 206/534 X

* cited by examiner

*Primary Examiner*—Christopher P. Ellis
*Assistant Examiner*—Gene O. Crawford
(74) *Attorney, Agent, or Firm*—Arter & Hadden LLP

(57) ABSTRACT

The present invention discloses an apparatus for storing fresh, edible seeds in a lower container having an upper container attached thereto for receiving the shells from the used or shucked seeds. The upper portion of the top chamber is a dome-like member with an aperture therein for the disposal of shells. Further, the top chamber has a dome-like lid that rotates being spill-proof when not in use. The bottom chamber is cylindrically shaped for receiving and storing fresh seed. The top and bottom chambers are removably attached. An access means is disposed on the outside of the lower container and enables seeds to be dispensed therethrough.

14 Claims, 4 Drawing Sheets

APPARATUS FOR SEED CONTAINER AND SHELL RECEPTACLE

BACKGROUND OF THE INVENTION

1. Field of the Invention

The present invention relates generally to a container, and more particularly, is concerned with a seed container and seed shell receptacle.

2. Description of the Prior Art

Devices for seed related containers have been described in the prior art. However, none of the prior art devices disclose the unique features of the present invention.

In U.S. Pat. No. 4,084,726, dated Apr. 18, 1978, Nicol disclosed a finger-held and operated small seed dispenser which has a seed container having one open end through which the container may receive the seeds to be dispensed, the open end being closed by a removable spout through which the seeds may pass; a seed dispensing rod extends through said container and the spout and beyond the enclosed end and there has a fingerpiece, said rod having a cylindrical portion that normally closes the open end of the spout against the escape of the seeds until the rod is finger operated, the rod having a longitudinal groove for the passage of the seeds and a transverse groove to facilitate the entrance of the seeds into the longitudinal groove.

In U.S. Pat. No. Des. 313,098, dated Dec. 18, 1990, Boyd disclosed the ornamental design for a pocket spittoon, as shown and described.

In U.S. Pat. No. 5,664,506, dated Sep. 9, 1997, Morin disclosed a seed dispenser composed of a motor-spatula assembly and a handle. A switch, an adjustable resistor and a battery are enclosed in a hollow of the handle. The motor-spatula assembly includes a V-shaped spatula and an electrical motor elastically mounted to a proximal end of the V-shaped spatula, and the motor is connected via the switch and resistor to the battery. The motor rotor is eccentric so that the rotational center of gravity of the rotor is not exactly co-axial with the axis of the rotor drive shaft, to cause when running a vibration of the motor-spatula assembly at a dominant vibration frequency that is directly proportional to the speed of the rotor. Speed of the motor is adjustable by varying the resistor. The motor-spatula assembly mounted to the handle through a resilient elastomeric gasket, so that a substantial part of the motor vibration energy is transmitted to the spatula and not to the handle. For more effective singulation and enhanced regularity in the dispensing of very small seeds, a series of dremples is formed in the spatula protruding inward toward the trough of the spatula. For large seeds, eccentricity of the rotor may be increased b providing eccentricity of the extending portion of the rotor drive shaft. For more vigorous dispensing of large seeds, the extending eccentric drive shaft may be caused to repeatedly strike a bolt mounted in the motor-spatula assembly.

In U.S. Pat. No. Des, 371,057, dated Jun. 25, 1996, Nicol disclosed the ornamental design for a seed dispenser, as shown and described.

In U.S. Pat. No. Des. 255,416, dated Jun. 17, 1980, Nicol disclosed the ornamental design for a seed dispenser, as shown.

While these seed related containers may be suitable for the purposes for which they were designed, they would not be as suitable for the purposes of the present invention, as hereinafter described.

SUMMARY OF THE INVENTION

The present invention discloses an apparatus for storing fresh, edible seeds in a lower container having an upper container attached thereto for receiving the shells from the used or shucked seeds. The upper portion of the top chamber is a dome-like member with an aperture therein for the disposal of shells. Further, the top chamber has a dome-like lid that rotates being spill-proof when not in use. The bottom chamber is cylindrically shaped for receiving and storing fresh seed. The top and bottom chambers are removably attached. An access means is disposed on the outside of the lower container and enables seeds to be dispensed therethrough.

An object of the present invention is to simplify the process of shelling and eating sunflower seeds or the like by requiring only one container. A further object of the present invention is to allow the consumer of sunflower seeds to only have one container which serves as both a receptacle and container for the seeds. A further object of the present invention is to free one hand of the consumer while consuming sunflower seeds. Another object of the present invention is to provide a container for sunflower seeds which avoids having a spit cup or bag for the seeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 3:
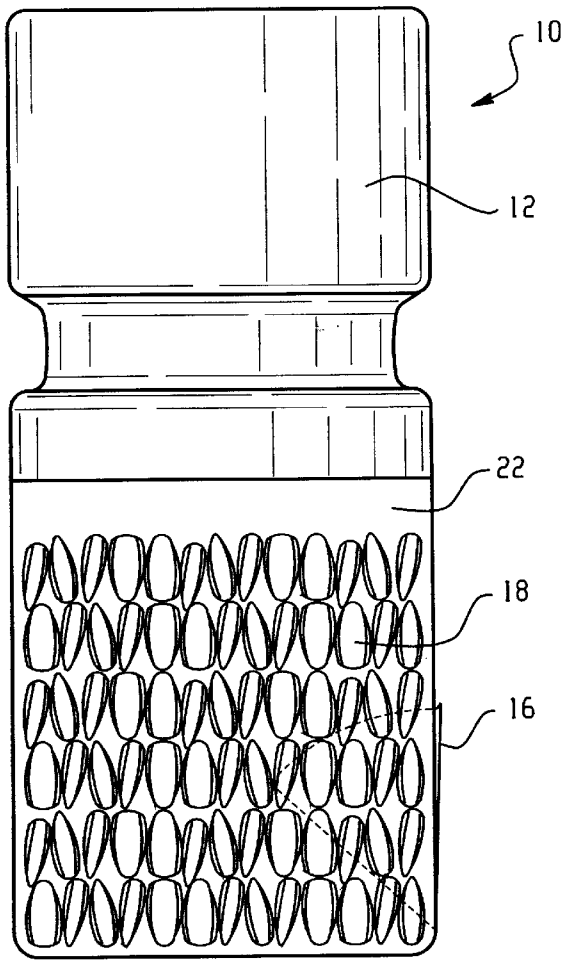
FIG. 3 is an elevation view of one embodiment of the present invention.

With regard to reference numerals used, the following numbering is used throughout the drawings.

10 present invention
12 upper container
14 upper aperture
16 lower door
18 seed

20 rotatable disk top
22 lower container
24 shells
26 bottom of upper container
28 female threads
30 male threads
34 recess
36 top of upper container
38 opening
39 live hinge
40 upper dome
42 aperture
44 door handle
46 aperture
48 door
50 recess
52 aperture
54 attachment means
56 attachment means
58 lip
60 knurled area
62 means for attaching
64 means for attaching
66 enlarged head

DESCRIPTION OF THE PREFERRED EMBODIMENT(S)

Turning now descriptively to the drawings, in which similar reference characters denote similar elements throughout the several views, FIGS. 1 through 7 illustrate the present invention being a seed container and shell receptacle.

Figure 1:
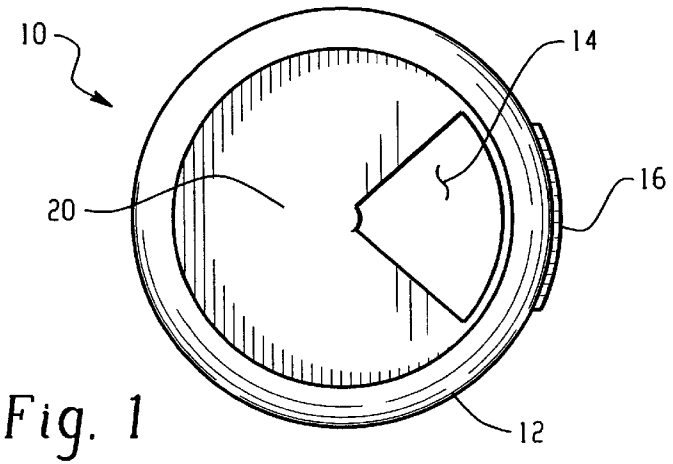
FIG. 1 is a plan view of one embodiment of the present invention.

Turning to FIG. 1, therein is shown a plan view of one embodiment of the present invention 10. Shown therein is the upper circumference of the upper container 12. Also shown is the upper opening 14 through which the shucked seeds can be deposited and rotatable top 20. Also shown is the outer edge of the lower access door 16.

Figure 2:
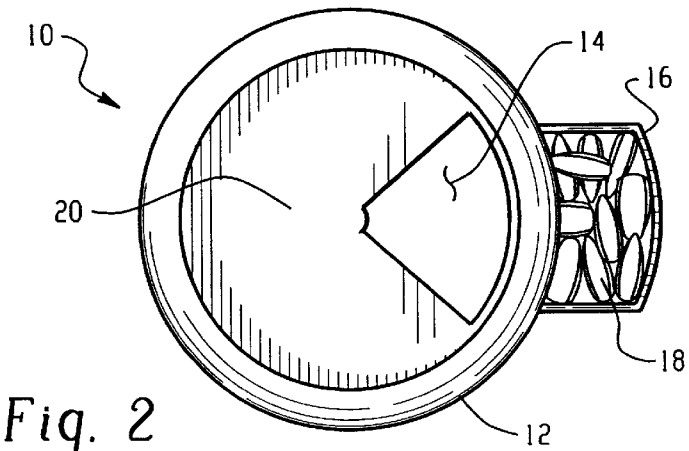
FIG. 2 is a plan view of one embodiment of the present invention.

Turning to FIG. 2, therein is shown a plan view of one embodiment of the present invention 10 showing the lower door 16 having fresh seeds 18 therein which door 16 is in the open position. Also shown is the upper container 12 along with the top 20 and upper aperture 14.

Turning to FIG. 3, therein is shown an elevational view of one embodiment of the present invention 10 showing the upper container 12 and the lower container 22. The access door 16 is also shown along with seeds 18.

Figure 4:
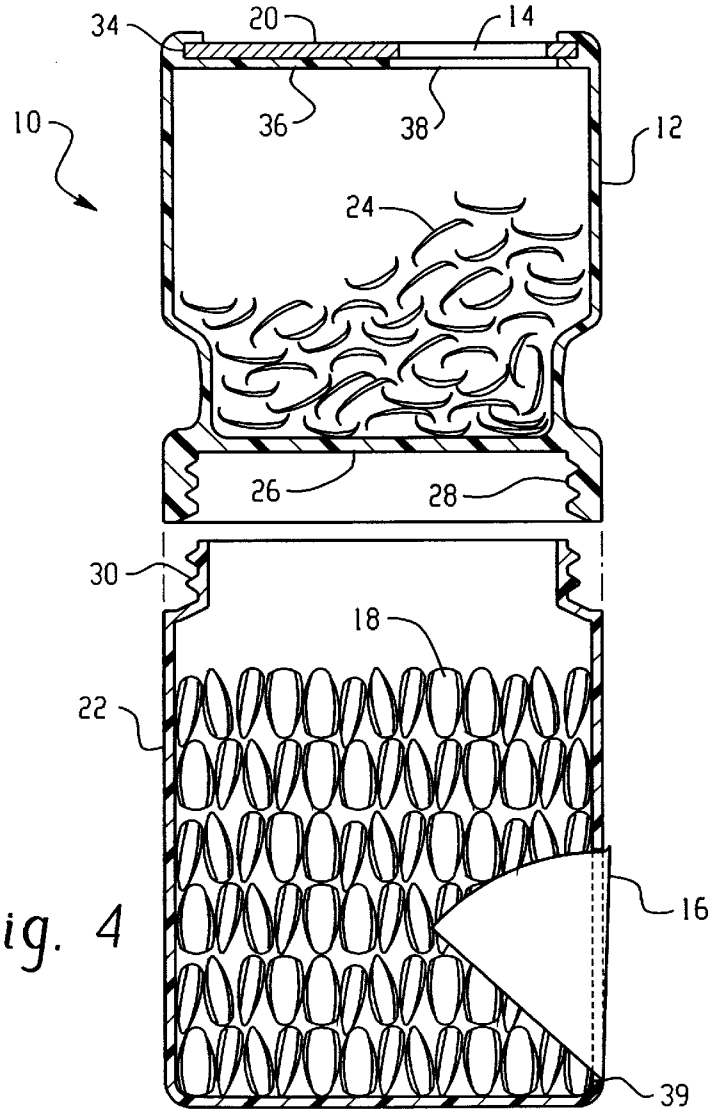
FIG. 4 is a cross-sectional view of one embodiment of the present invention.

Turning to FIG. 4, therein is shown a cross-sectional view of one embodiment of the present invention 10. Shown is the upper container 12 having shucked shells 24 deposited therein. Also shown is the bottom 26 of the upper container 12 along with female threaded members 28 which overlap and mate to male threaded members 30 located on the upper edge of the lower container 22. Also note that the closure mechanism for the upper container 12 comprises a rotatable disk 20 which rotates in a recess 34 positioned above a top 36 of the upper container 12, which top 36 has an opening 38 therein so that when the aperture 14 of the rotatable disk 20 aligns with aperture 38 the apertures 14, 38 are positioned over each other and an opening for placing the shells 24 into upper container 12 is provided. Note that door 16 is hingedly attached at 39 by a live hinge or the like which door 16 provides access to the seeds 18.

Figure 5:
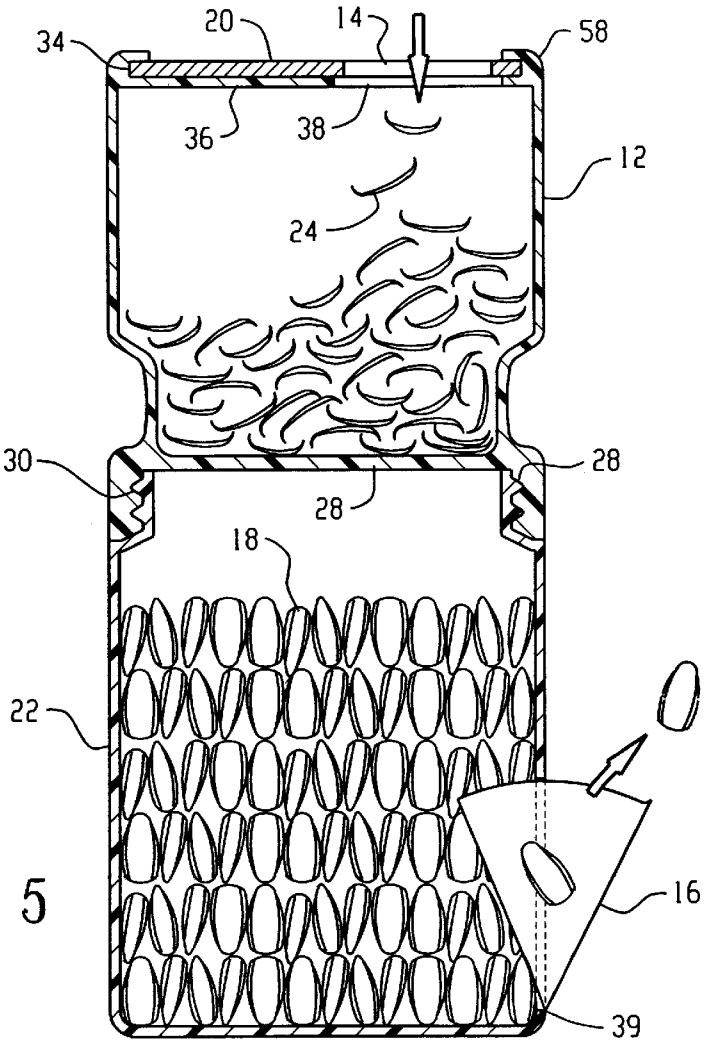
FIG. 5 is a cross-sectional view of one embodiment of the present invention.

Turning to FIG. 5, therein is shown a cross-sectional view of one embodiment of the present invention 10. Shown is the upper container 12 having shucked shells 24 deposited therein. Also shown is the bottom 26 of the upper container 12 along with female threaded members 28 which overlap and mate to male threaded members 30 located on the upper edge of the lower container 22. Also note that the closure mechanism for the upper container 12 comprises a rotatable disk 20 which rotates in a recess 34 positioned in an upwardly extending lip 58 above a top 36 of the upper container 12, which top 36 has an opening 38 therein so that when the aperture 14 of the rotatable disk 20 aligns with aperture 38 the apertures 14, 38 are positioned over each other and an opening for placing the shells 24 into upper container 12. Note that door 16 is hingedly attached at 39 by a live hinge or the like which door 16 provides access to the seeds 18.

Figure 6:
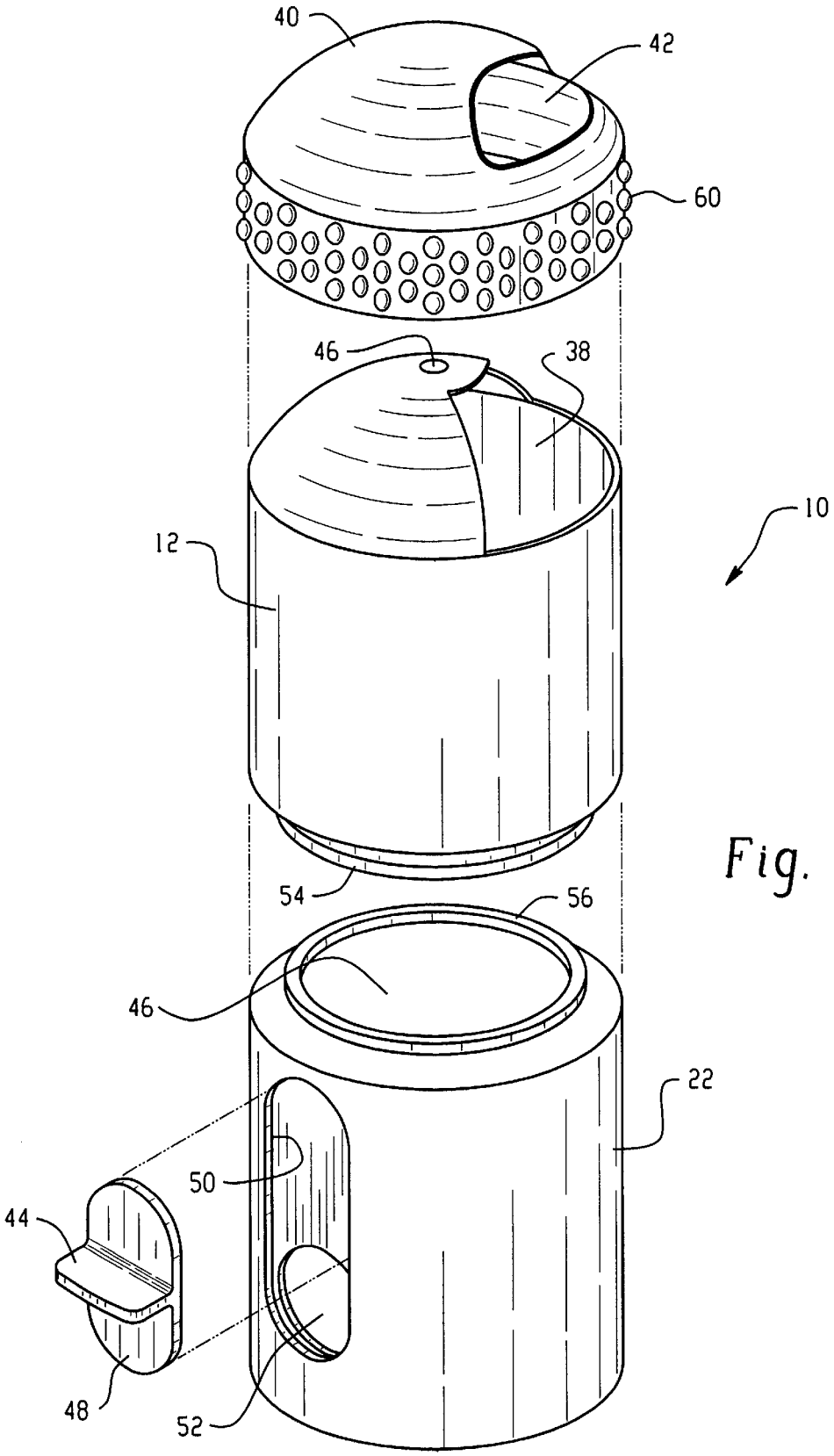
FIG. 6 is an exploded view of the preferred embodiment of the present invention.

Turning to FIG. 6, therein is shown an exploded view of the preferred embodiment of the present invention 10. Shown therein is the upper container 12 having an aperture 38 therein and an upper dome member 40 having an aperture 42 therein which upper member 40 has a knurled area 60 thereon and is rotatable about and which encircles the upper periphery of the upper container 12. Also shown therein is the lower container 22 having an upper aperture 46 therein along with a vertically slidable door 48 with protruding handle 44, which door 48 operates within a recessed area 50 positioned in the wall of the lower container 22. When door 48 is moved to an upward position an aperture 52 is exposed from which fresh seeds can be removed from the interior of the lower container 22. Also shown on the upper container 12 is a mating attachment means 54 on its lower edge which overlaps and attached to a mating member 56 on the upper edge of the lower container 22 whereby the upper container 12 is removably attached to lower container 22. When aperture 42 of dome 40 is rotated to align with aperture 38 an opening into upper container 12 is provided.

Figure 7:
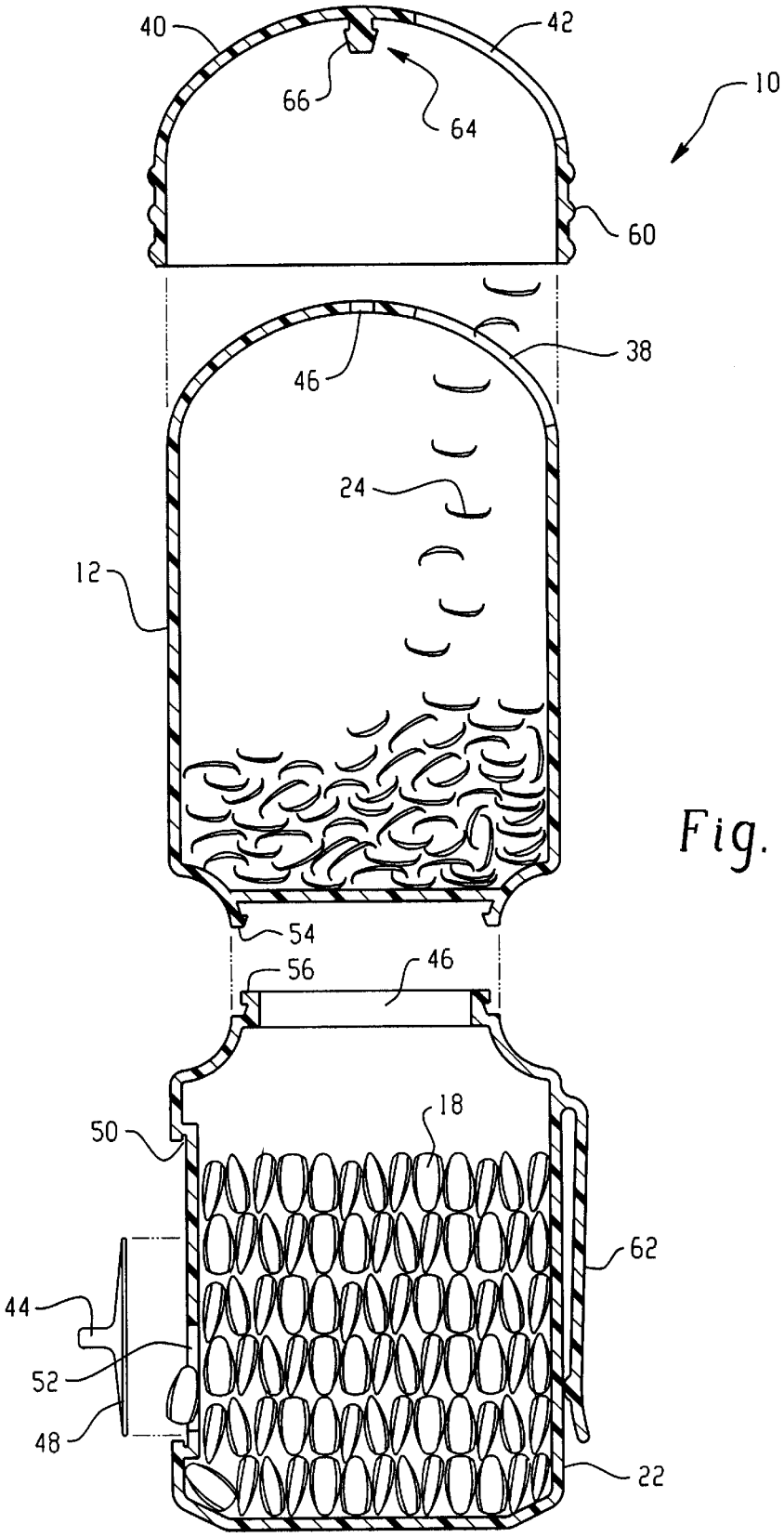
FIG. 7 is a cross-sectional view of the preferred embodiment of the present invention.

Turning to FIG. 7, therein is shown a cross-sectional view of the preferred embodiment of the present invention 10. Shown therein is the upper container 12 having an aperture 38 therein and an upper dome member 40 having an aperture 42 therein which upper member 40 is rotatable about and which encircles the upper periphery of the upper container 12. Note that the upper member 40 may be made in the shape and/or likeness of sport or other novelty members including a baseball, basketball, football or the like. Also shown therein is the lower container 22 having an upper aperture 46 therein along with a vertically slidable door 48 with protruding handle 44, which door 48 operates within a recessed area 50 positioned in the wall of the lower container 22. When door 48 is moved to an upward position an aperture 52 is exposed from which fresh seeds 18 can be removed from the interior of the lower container 22. While seeds 18 are shown, the present invention 10 can be used for all edible or consumable products, e.g., pumpkin seeds, pistachios, chewing tobacco or the like. Means 64 for attaching the dome 40 to upper container 12 is shown having an enlarged head 66 thereon for insertion into and connection to aperture 46 in the standard manner. Also shown on the upper container 12 is a mating attachment means 54 on its lower edge which overlaps and attached to a mating member 56 on the upper edge of the lower container 22 whereby the upper container 12 is removably attached to lower container 22. Means 62 for attaching the present invention 10 to a belt or the like is also shown.

I claim:

1. An apparatus for a seed container and shell receptacle, comprising:

a) an upper cylindrically shaped container having an aperture in its top, said container for receiving the shells;

b) a lower cylindrically shaped container having an aperture in its top, said container for containing the seeds;

c) a means for closing said aperture in said top of said upper container, said means for closing further comprises a rotatable dome-shaped member having an aperture disposed off-center from its apex, the rotatable dome-shaped member further comprising a knurled-like area disposed circumferentially around the lower edge of said dome-shaped member whereby the shells do not spill out;

d) a means for access into said lower container disposed in the wall of said lower container, said means for access providing an access to the seeds contained therein; and, e) a means for removably attaching said upper container to said lower container, said upper container being disposed on top of said lower container, the bottom of said upper container forming a top for said lower container.

2. The apparatus of claim 1, wherein said means for attaching further comprising a first and second overlapping mating edge, said first edge disposed on the lower peripheral circumference of said upper container, and said second edge disposed on the upper peripheral circumference of said lower container.

3. The apparatus of claim 1, said means for attaching further comprising a first female threaded member and a mating second male threaded member, said first female threaded member disposed on the lower peripheral circumference of said upper container, and said mating second male threaded member disposed on the upper peripheral circumference of said lower container.

4. The apparatus of claim 1, further comprising means for attaching said lower container to a belt or the like.

5. The apparatus of claim 1, said means for access further comprising a vertically sliding member disposed in the wall of said lower cylindrically shaped container, said wall having a recessed area therein for receiving said sliding member.

6. The apparatus of claim 5, said means for access has an aperture therein, said aperture encircled by said recessed area, whereby when said sliding member is in a first position said apertureis covered by said sliding member, whereby when said sliding member is in a second position said aperture is uncovered by said sliding member.

7. The apparatus of claim 1, said means for access further comprising a hinged door, said door being hinged on its lower edge to the wall of said lower container.

8. The apparatus of claim 7, wherein said hinge is a live hinge.

9. The apparatus of claim 1, said upper cylindrically shaped container having a fixed dome-shaped top thereon, said dome-shaped top having an aperture therein, said aperture disposed on its apex.

10. The apparatus of claim 9, said rotatable dome-shaped member further comprising a means for attachment to said upper container, said means for attachment disposed on its interior surface at its apex.

11. The apparatus of claim 10, wherein said means for attachment being downwardly extending having an enlarged head member thereon for mating with said aperture disposed at said apex of said fixed dome-shaped top on said upper container.

12. The apparatus of claim 1, said means for closing said aperture in said top of said upper container further comprises a rotatable disk, said disk generally horizontally disposed, said disk having an aperture therein, said aperture disposed off-center of said disk.

13. The apparatus of claim 12, said top of said upper container having a raised lip thereon, said lip having an inwardly disposed recess therein, said recess for receiving said horizontally disposed disk.

14. The apparatus of claim 13, said disk having an aperture therein alignable with said aperture in said top of said upper container.

* * * * *